US007148775B2

(12) United States Patent
Park

(10) Patent No.: US 7,148,775 B2
(45) Date of Patent: Dec. 12, 2006

(54) CONTACTOR ASSEMBLY FOR CIRCUIT BREAKER

(75) Inventor: Jin-Young Park, Chungcheongbuk-Do (KR)

(73) Assignee: LS Industrial Systems Co., Ltd., Seoul (KR)

( * ) Notice: Subject to any disclaimer, the term of this patent is extended or adjusted under 35 U.S.C. 154(b) by 21 days.

(21) Appl. No.: 11/294,548

(22) Filed: Dec. 6, 2005

(65) Prior Publication Data

US 2006/0119455 A1 Jun. 8, 2006

(30) Foreign Application Priority Data

Dec. 7, 2004 (KR) ..... 10-2004-0102676

(51) Int. Cl.
*H01H 75/00* (2006.01)

(52) U.S. Cl. ..... 335/16; 335/195; 218/22

(58) Field of Classification Search ..... 335/16, 335/147, 195; 218/22
See application file for complete search history.

(56) References Cited

U.S. PATENT DOCUMENTS 5,310,971 A * 5/1994 Vial et al. ..... 200/244
6,403,909 B1 * 6/2002 Green et al. ..... 218/22
6,429,759 B1 * 8/2002 Schlitz et al. ..... 335/16
6,639,168 B1 * 10/2003 Castonguay et al. ..... 218/22
7,005,594 B1 * 2/2006 Kim ..... 200/244
2005/0231308 A1 10/2005 Kim

OTHER PUBLICATIONS

U.S. Appl. No. 11/239,049, to Kim, filed Sep. 30, 2005.

* cited by examiner

*Primary Examiner*—Lincoln Donovan
(74) *Attorney, Agent, or Firm*—Greenblum & Bernstein, P.L.C.

(57) ABSTRACT

A contactor assembly for a circuit breaker is disclosed. There is provided a contactor assembly, wherein stationary pins fixed to a rotary shaft and supporting one ends of springs and limit pins contacting the upper surface of the movable contactor and supporting the other ends of the springs are connected by link plates, comprising a movable contactor provided on the upper surface of the movable contactor with groove surfaces having a constant first curvature radius and curve surfaces having a constant second curvature radius larger than the first curvature radius. By this, a contact pressure provided by the springs is constant, and a separating position can be maintained when separating the contactor by an electromagnetic repulsive force.

3 Claims, 6 Drawing Sheets

CONTACTOR ASSEMBLY FOR CIRCUIT BREAKER

BACKGROUND OF THE INVENTION

1. Field of the Invention

The present invention relates to a mold cased circuit breaker which protects a circuit and load side equipment by automatically breaking the circuit when an overload or short-circuit occurs, and more particularly, to a contactor assembly for a circuit breaker.

2. Description of the Conventional Art

A mold cased circuit breaker (so called abbreviated MCCB) is installed at an electric power distributing board among several electric power systems of a factory and a building. The circuit breaker serves as a switch for supplying or cutting off power to a load side under no load state, and cuts off power supplied to a load side from a power source side in order to protect a circuit and components of the load side when a great abnormal current due to a short-circuit or a ground fault flows on a circuit under a load state.

FIG. 1 is a cross sectional view showing the main internal configuration of a conventional circuit breaker. FIG. 2 shows a movable contactor assembly for the conventional circuit breaker, which is a front view showing a status where contacts contact each other (On Status). FIG. 3 shows the movable contactor assembly for the conventional circuit breaker, which is a front view showing a status where the contacts are separated (Off Status).

As illustrated therein, the conventional circuit breaker 1 comprises a mold case 10, stationary contactors 9 and 9' installed at regular intervals within the mold case 10 in horizontal and vertical directions, a rotary type movable contactor assembly 17 rotatably installed between the stationary contactors 9 and 9', a trip mechanism 11 for sensing a large current and tripping the breaker, a switching mechanism 12 being operated automatically by the trip mechanism 11 or operated by manual manipulation of a handle 1*a* and for separating a movable contactor 4 from the stationary contactors 9 and 9' and breaking the circuit, and an arc extinguishing mechanism 13 for extinguishing a high temperature, high pressure arc gas produced between a contact 4*b* of the movable contactor 4 and contacts 9*b* and 9*b*' of the stationary contactors 9 and 9' upon the on-off operation of the circuit.

The mold case 10 houses the above mechanisms, is formed of insulating material and serves to insulate between the mechanisms, between phases and from the outside and prevents this material from penetrating into the mold case 10.

The contacts 9*a* and 9*b* are formed at the ends of the stationary contactors, i.e., the stationary contactor 9' at the power source side and the stationary contactor 9' at the load side, and the contact 4*b* is formed at the end of the movable contactor 4.

The conventional movable contactor assembly 17 comprises a rotary shaft 2 being rotatably installed between the stationary contactors 9 and 9' for maintaining an On status or Off status and being installed between the movable contactor 4 having cam surfaces 4*c* and cam grooves 4*d* and the stationary contactors 9 and 9' for supporting the movable contactor 4, limit pins 19 being contacted with the cam surfaces 4*c* and the cam grooves 4*d*, and a plurality of springs 15 and 16 for elastically rotating the movable contactor 4 around a virtual rotational axis (rotation center) 2*a* by an electromagnetic repulsive force generated at each of the contacts 9*b* and 9*b*' when a large current flows due to the abnormality in the circuit.

One ends 15*a* and 16*a* of the plurality of springs 15 and 16 are fixed to the limit pins 19, and the other ends 15*b* and 16*b* are fixed to the rotary shaft 2. For reference, a method of supporting the movable contactor 4 on the rotary shaft 2 around a virtual rotational axis (rotary center) 2*a*, though not actually existing, is referred to as self-centering.

As illustrated in FIG. 2, a status where the contact 4*b* of the movable contactor 4 and the contacts 9*b* and 9*b*' of the stationary contactors 9 and 9' are contacted with each other is referred to as "Off Status", and as illustrated in FIG. 3, a status where the contact 4*b* of the movable contactor 4 and the contacts 9*b* and 9*b*' of the stationary contactors 9 and 9' are separated from each other is referred to as "On Status". A status where the Off Status is being converted into the On status is referred to as separating and opening.

As illustrated in FIG. 2, in the Off status, a normal current flows through the circuit, whereupon the limit pins 19 presses the cam surfaces 4*c* of the movable contactor 4 by a constant pressure by means of the tensile strength of the springs 15 and 16, thereby maintaining the movable contactor 4 and the stationary contactors 9 and 9' to be contacted with each other.

In contrast, as illustrated in FIG. 3, in the event that a large current flows through the circuit due to a short-circuit of the circuit, the movable contactor 4 rotates clockwise by an electromagnetic repulsive force between the contact 4*b* of the movable contactor 4 and the contacts 9*b* and 9*b*' of the stationary contactors 9 and 9'. At this point, the contact 4*b* is separated from the contacts 9*b* and 9*b*', thereby breaking the circuit. Unexplained reference numeral 18 represents a stopper for limiting the rotating range of the movable contactor.

However, in the movable contactor assembly for the conventional circuit breaker, the contact pressure of the springs 15 and 16' is not constant, including the problems that contact pressure of the springs 15 and 16' further increases when an over travel occurs by which the rotary shaft 2 rotates further than the movable contactor 4 at a contact position where the movable contactor 4 is stopped in contact with the stationary contactors 9 and 9', and the contact pressure of the springs 15 and 16 changes according to the position of the limit pins on the cam surfaces 4*c* and cam grooves 4*d*. Therefore, when the movable contactor 4 rotates separately from the stationary contactors 9 and 9' due to an electromagnetic repulsive force caused by the application of a large current, if the electromagnetic repulsive force becomes smaller than the contact pressure, the movable contactor 4 returns to the position contacting the stationary contactors 9 and 9'. As a result, the current limiting operation is failed. Due to this, an arc is continuously generated, and thus the instantaneous current limiting characteristic cannot be obtained, and a serious damage can be given to the circuit breaker and the load equipment.

BRIEF DESCRIPTION OF THE INVENTION

Therefore, the present invention is directed to solve the above problems, and has for its object to provide a contactor assembly for a circuit breaker which can maintain a constant contact pressure between contacts by means of springs regardless of the rotating position of a rotary shaft at a contact position, and which can maintain a separated position for a predetermined time without a movable contactor returning toward stationary contactors after completion of separating and opening the contacts.

The aforementioned object of the present invention is accomplished by providing a contactor assembly for a circuit breaker, comprising: a stationary contactor provided with a U-shaped first stationary contactor connected to a power source on an electrical circuit and a U-shaped second stationary contactor being spaced apart a predetermined distance from the first stationary contactor in horizontal and vertical directions and being connected to an electrical load on the electrical circuit; a movable contactor provided with contacts corresponding to the first and second stationary contactors at both ends and being movable to a contact position contacting the first and second stationary contactors and a separating position where the movable contactor is separated from the first and second stationary contactors, the movable contactor being provided with groove surfaces having a first curvature radius on respective upper and lower surface thereof so that the separating position of the movable contactor can be maintained when the movable contactor rotates separately from the stationary contactors by an electromagnetic repulsive force between the stationary contactor and the movable contactor, and curve surfaces having a second curvature radius larger than the first curvature radius in succession with the groove surface on respective upper and lower surfaces thereof; a rotary shaft rotatably supporting the movable contactor, being provided with an opening portion for permitting an independent rotation of the movable contactor when an electromagnetic repulsive force is generated between the movable contactor and the stationary contactor, and being further rotatable than the movable contactor at the contact position where the movable contactor contacts the stationary contactor; a center shaft pin penetrating the movable contactor and being supported on the center portion of the rotary shaft so as to support the movable contactor on the rotary shaft; a pair of stationary pins fixedly mounted on the rotary shaft symmetrically with each other around the center portion of the rotary shaft; two pairs of link plates whose one ends are rotatably supported on both ends of each of the stationary pins; a pair of limit pins rotatably supported on the other ends of the link plates and displaceable or maintaining a stopped state on the curve surfaces and groove surfaces of the movable contactor according to the position of the movable contactor; and two pairs of springs prepared such that the respective pair corresponds to each side of the rotary shaft so as to provide a contact pressure at the contact position where the movable contactor contacts the stationary contactor, one ends being supported on the stationary pins and the other ends being supported on the limit pins, wherein the stationary pins and limit pins supporting both ends of the springs are connected by the link plates, the limit pins are located on the curve surfaces of the movable contactor having a constant curvature radius at the contact position, the contact pressure provided by the springs can be maintained constant, the springs charge elastic energy according to a height difference between the groove surfaces and the curve surfaces at the contact position, and the springs discharge the charged elastic energy when the limit pins are located on the groove surfaces by the rotation of the movable contactor caused by the electromagnetic repulsive force.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIGS. 6 to 8 are cross sectional views showing an operating status of the contactor assembly for the circuit breaker according to the present invention, in which FIG. 6 is a cross sectional view of an operating status showing a status where the contacts are contacted (On Status), FIG. 7 is a cross sectional view showing a status where the contacts are being separated and opened by the electromagnetic repulsive force, and FIG. 8 is a cross sectional view showing a status where the separating and opening (current limiting operation) of the contacts by the electromagnetic repulsive force are completed.

DETAILED DESCRIPTION OF THE INVENTION

Hereinafter, a preferred embodiment of the present invention will be described in detail with reference to the accompanying drawings.

Figure 4:
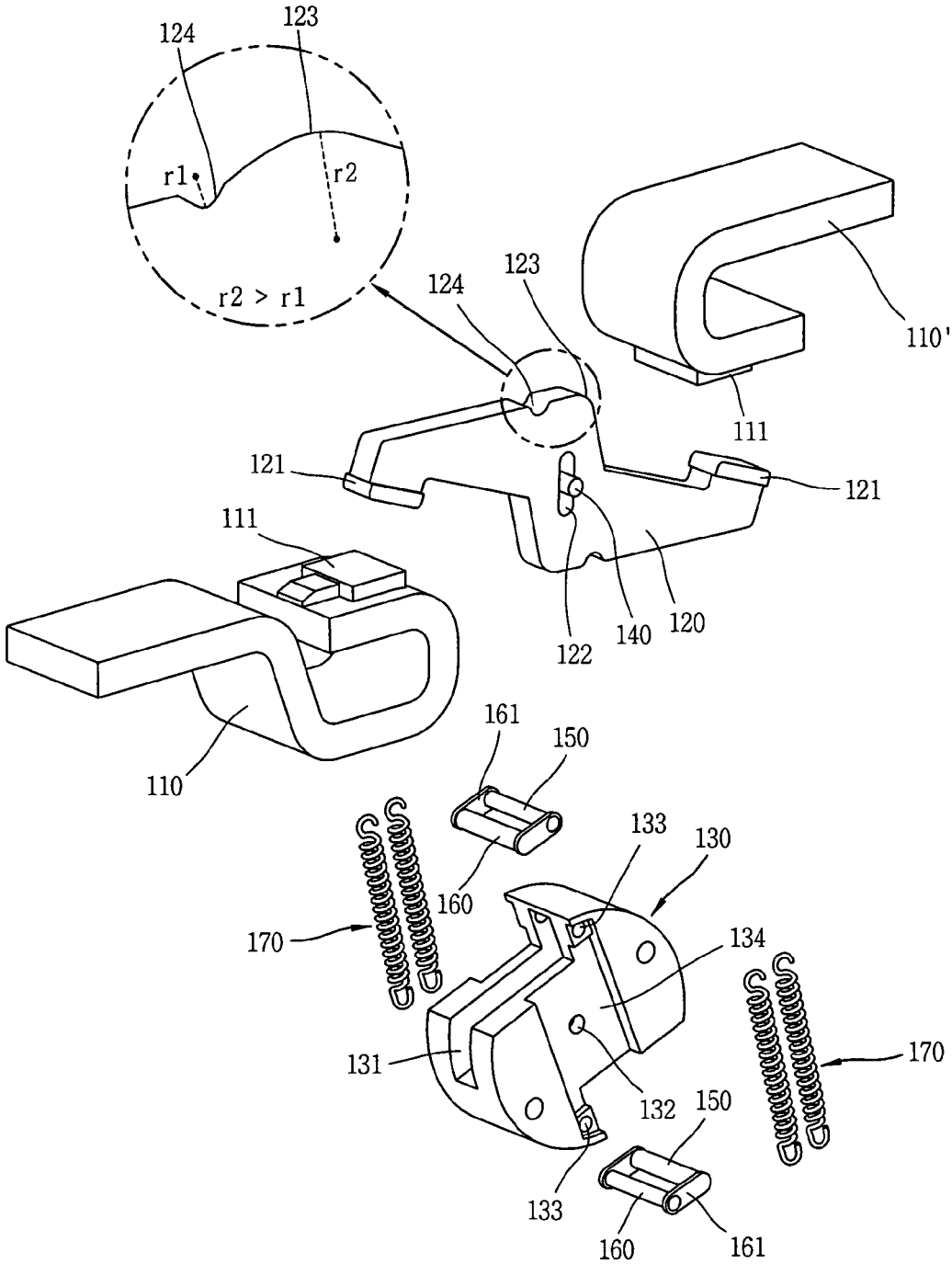
FIG. 4 is an exploded perspective view showing a contactor assembly for a circuit breaker according to the present invention.
Figure 5:
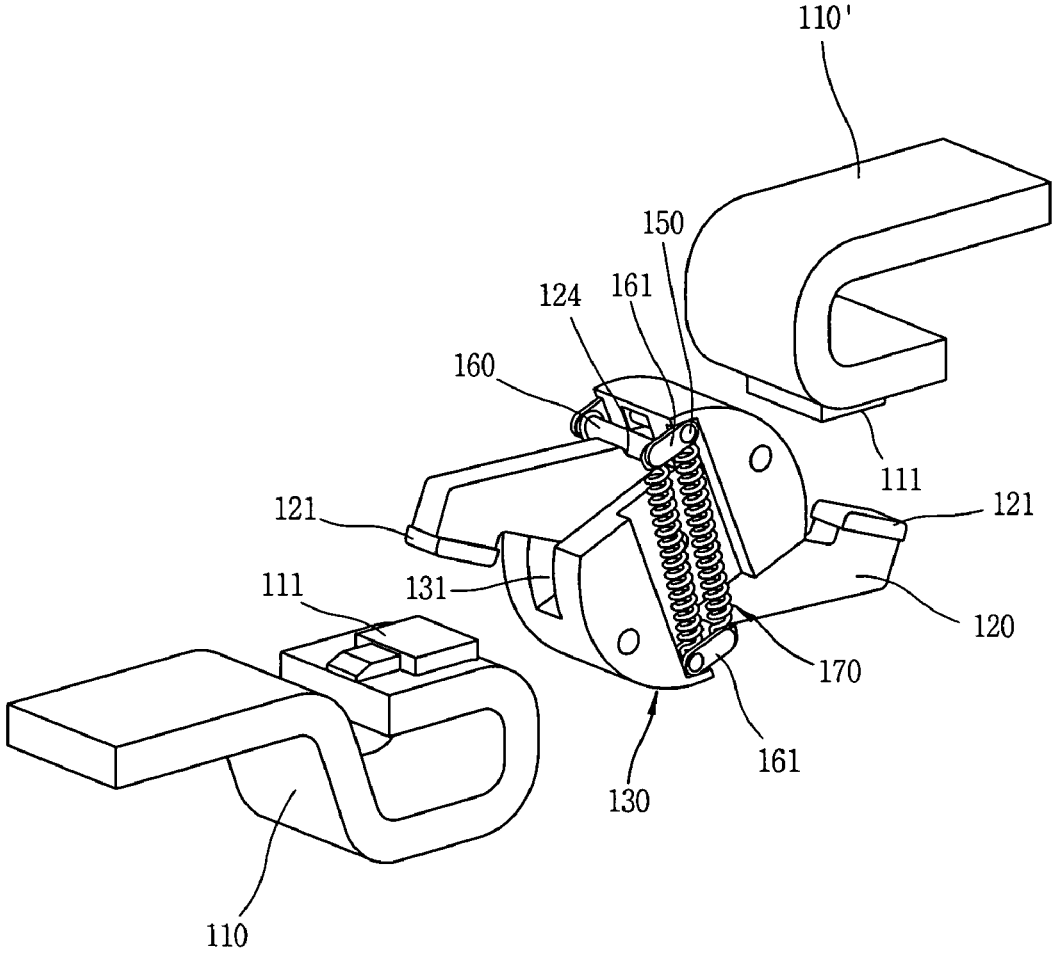
FIG. 5 is an assembly perspective view showing a status where the contactor assembly for the circuit breaker is assembled and a perspective view showing a current limiting status where contacts are separated and opened by an electromagnetic repulsive force according to the present invention.

First, as illustrated in FIGS. 4 and 5, a contactor assembly 100 for a circuit breaker according to the present invention includes a stationary contactor 110 and 110' provided with a U-shaped current limiting type first stationary contactor 110 connected to a power source on an electrical circuit and a U-shaped current limiting type second stationary contactor 110' being spaced apart a predetermined distance from the first stationary contactor 110 in horizontal and vertical directions and being connected to an electrical load on the electrical circuit. Stationary contacts 111 are attached to one ends of the first and second stationary contactors 110 and 110'. The contactor assembly 100 includes a movable contactor 120 provided at both ends with contacts 121 corresponding to the stationary contacts 111 of the first and second stationary contactors 110 and 110', and being movable and being movable to a contact position contacting the first and second stationary contactors 110 and 110' and a separating position where the movable contactor 120 is separated from the first and second stationary contactors 110 and 110'. The movable contactor 120 is provided with groove surfaces 124 having a first curvature radius r1 on respective upper and lower surface thereof and curve surfaces 123 having a second curvature radius r2 larger than the first curvature radius r1 in succession with the groove surfaces 124 on respective upper and lower surfaces thereof.

A rotary shaft 130 included in the contactor assembly of the present invention rotatably supports the movable contactor 120, and is provided with an opening portion 133 for permitting an independent rotation of the movable contactor 120 when an electromagnetic repulsive force is generated between the movable contactor 120 and the stationary contactor 110 and 110'. Here, the independent rotation of the movable contactor 120 means that only the movable contactor 120 independently rotates in a direction of being separated from the stationary contactor by an electromagnetic repulsive force caused by the application of a large current such as a short-circuit current, with the rotary shaft 130 being stopped, unlike the movable contactor 120 rotating in a direction of being separated from the stationary contactor by the rotation of the rotary shaft 130 upon a trip operation. The rotary shaft 130 is further rotatable than the movable contactor 120 in a state where the movable contactor 120 is stopped at the contact position where the movable contactor 120 contacts the stationary contactor 110 and 110'. That is, even though the movable contactor 120 was stopped in contact with the stationary contactors 110 and 110', the rotary shaft 130 is further rotatable in a direction of contacting the movable contactor 120 to the stationary contactors 110 and 110', i.e., counterclockwise as viewed in FIGS. 4 and 5.

The contactor assembly of the present invention includes a center shaft pin 140 penetrating the movable contactor 120 and being supported on the center portion of the rotary shaft 130 so as to support the movable contactor 120 on the rotary shaft 130;

The contactor assembly of the present invention includes a pair of stationary pins 150 fixedly mounted on the rotary shaft 130 symmetrically with each other around the center portion of the rotary shaft 130.

The contactor assembly of the present invention includes two pairs of link plates 161 whose one ends are rotatably supported on both ends of each of the stationary pins 150.

The contactor assembly of the present invention includes a pair of limit pins 160 rotatably supported on the other ends of the link plates 161 and displaceable or maintaining a stopped state on the curve surfaces 123 and groove surfaces 124 of the movable contactor 120 according to the position of the movable contactor 120.

The contactor assembly of the present invention includes two pairs of springs 170 prepared such that the respective pair corresponds to each side of the rotary shaft 130 so as to provide a contact pressure at the contact position where the movable contactor 120 contacts the stationary contactor 110 and 110', one ends being supported on the stationary pins 150 and the other ends being supported on the limit pins 160. Here, the stationary pins 150 and limit pins 160 supporting both ends of the springs 170 are connected by the link plates 161, the limit pins 160 are located on the curve surfaces 123 of the movable contactor 120 having a second constant curvature radius r2 at the contact position, and the contact pressure provided by the springs 170 can be maintained constant.

The movable contactor 120 is provided with a vertical long hole 122 through which a center shaft pin 140 passes so as to be movable in a vertical direction around the center shaft pin 140.

The opening portion 131 of the rotary shaft 130 permitting an independent rotation of the movable contactor 120 means a space formed on the rotary shaft 130 for permitting the independent rotation of the movable contactor 120.

In FIGS. 4 and 5, unexplained reference numeral 133 designates a stationary pin hole into which the stationary pin 150 is inserted and mounted, and unexplained reference numeral 134 designates a spring receiving groove formed concave on the rotary shaft 130 so as to receive the springs 170.

As the springs 170 are received in the spring receiving groove 134, they are not protruded to the outer side of the rotary shaft 130, thereby compactly constructing the contactor assembly for the circuit breaker.

The operation of the contactor assembly for the circuit breaker for power distribution according to the present invention thus constructed will now be described with reference to FIGS. 6 to 8.

Figure 6:
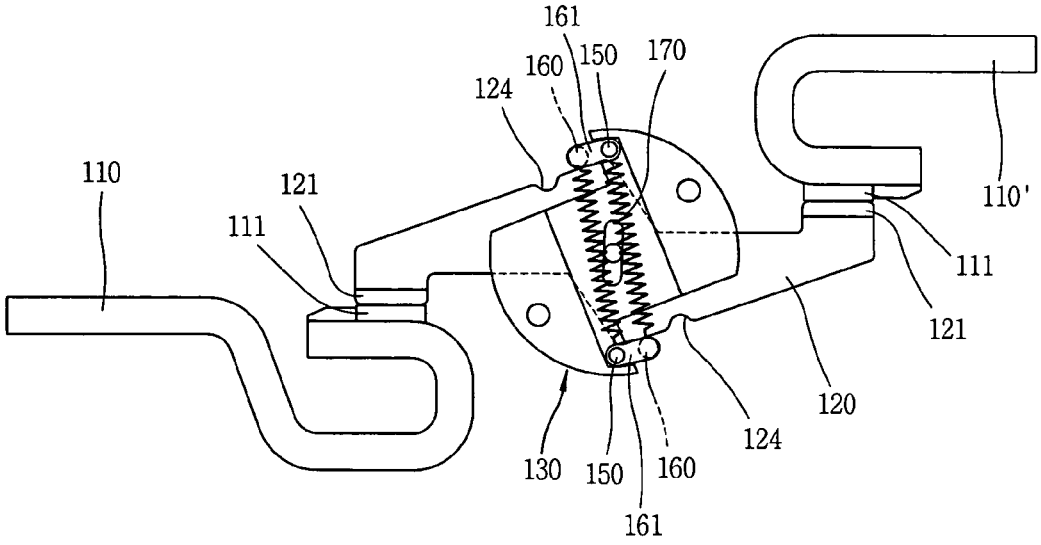
Figure 7:
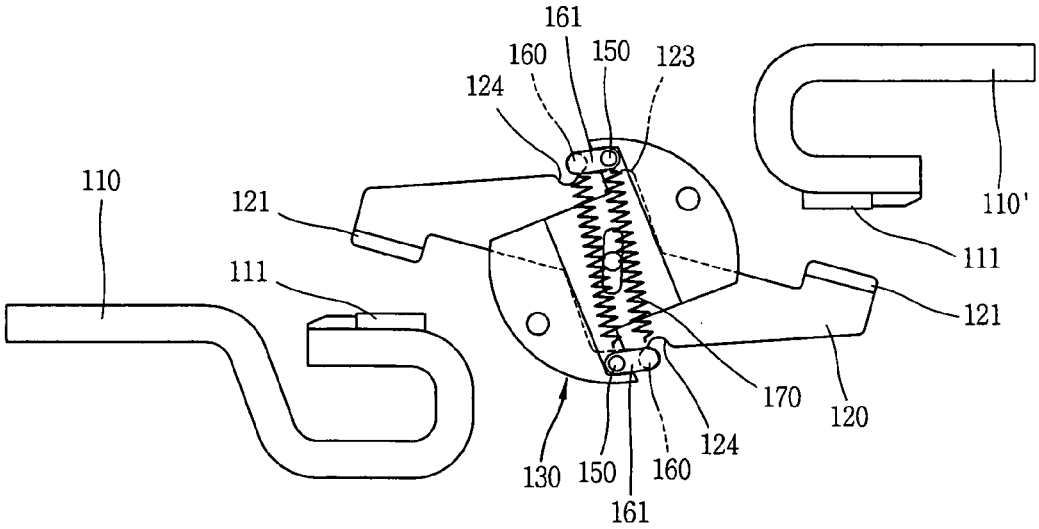

First, in a normal current carrying status, i.e., a closed status, as illustrated in FIG. 6, where the rotary shaft 130 rotates counterclockwise by power provided from an on-off mechanism (not shown) to contact the movable contactor 120 supported by the rotary shaft 130 to the stationary contactor 110 and 110', a current passes through the first stationary contactor 110 from the power source and flows out to the load via the second stationary contactor 110' at the load side through the movable contactor 120.

At this point, the limit pins 160 are located on the curve surfaces 123 of the movable contactor 120 and thus, the springs 170 are stretched as long as the difference in height between the curve surfaces 123 and the groove surfaces 124, thereby charging elastic energy. Therefore, the springs 170 pull the limit pins 160 toward the center shaft pin 140, and provides a moment so that the limit pins 160 presses the curve surfaces 123 of the movable contactor 120 to rotate the movable contactor 120 in a direction contacting the stationary contactor 110 and 110', that is, counterclockwise in the drawing. Accordingly, the contacts 121 of the movable contactor 120 and the contacts 111 of the stationary contactors 110 and 110' maintaining a contact state. At this time, the provision of a moment from the springs 170 so that the movable contactor 120 rotates in a direction contacting the stationary contactor 110 and 110', i.e., counterclockwise in the drawing is referred to as the provision of a contact pressure.

At this point, in the present invention, even when the movable contactor 120 contacts the stationary contactor 110 and 110', that is, the rotary shaft 130 over travels by which the rotary shaft 130 rotates further in a contact direction (counterclockwise in FIG. 6), the stationary pins 150 and limit pins 160 supporting both ends of the springs 170 are connected by the link plates 161, the limit pins 160 are located on the curve surfaces 123 of the movable contactor 120 having a constant curvature radius at the contact position, and the contact pressure provided by the springs 170 can be maintained constant.

When a large current such as a short-circuit current flows through the contactor assembly of the present invention at the above-said position, an electromagnetic repulsive force is generated between the contacts 121 of the movable contactor 120 and the contacts 111 of the stationary contactor 110 and 110'.

Typically, when a large accident current, such as a short-circuit, is generated, such an electromagnetic repulsive force is larger than a contact pressure caused by the springs 170. Thus, as shown in FIG. 7, the movable contactor 120 overcomes the contact pressure and starts to rotate clockwise. At this point, the limit pins 160 slide along the curve surfaces 123 having a constant curvature radius by the elastic force of the springs 170 right until before they are inserted into the grooves surfaces 124 of the movable contactor 120, and accordingly the moment (contact pressure) of the contact direction generated by the springs 170 are maintained constant.

Figure 8:
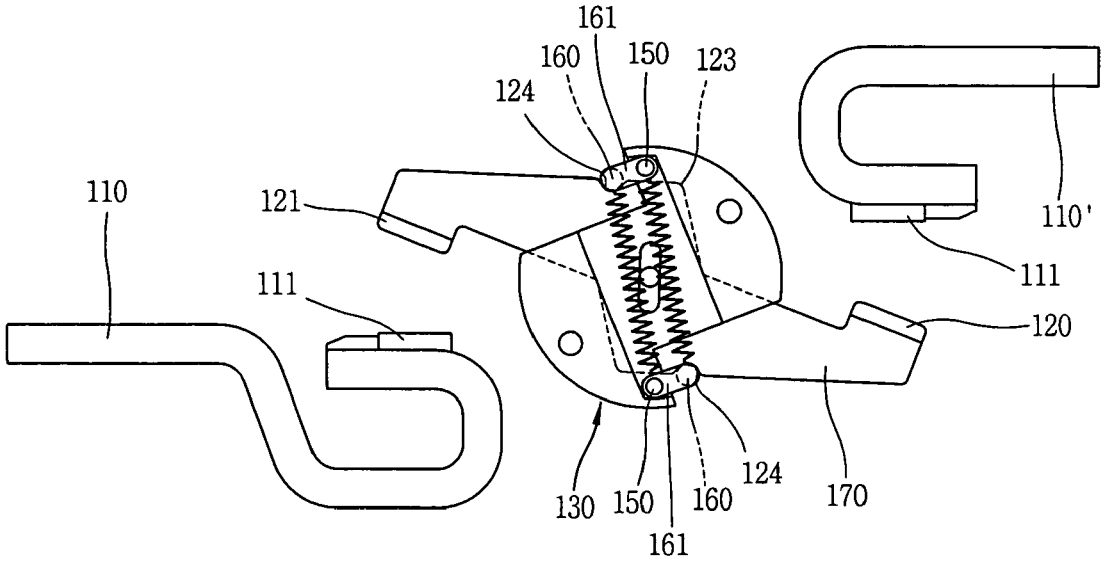

As illustrated in FIG. 8, in the step of completion of separating and operating, an arc generated between the contacts 121 and 111 of the movable contactor 120 and stationary contactor 110 and 110' is extinguished to thus completely separate the contacts 121 and 111 of the movable contactor 120 and stationary contactor 110 and 110' mechanically and electrically.

As illustrated in FIG. 8, when the limit pins 160 are inserted into the groove surfaces 124 by clockwise rotation of the movable contactor 120, the springs 170 are stretched as long as the difference in height between the curve surfaces 123 and the groove surfaces 124 and discharge the charged elastic energy. Subsequently, the contact pressure caused by the springs 170 becomes zero or at least smaller than the electromagnetic repulsive force. As a result, the status as in FIG. 8 is maintained in which the movable contactor 120 is prevented from returning toward the stationary contactor 110 and 110' and the movable contactor 120 is separated from the stationary contactor 110 and 110'.

Figure 1:
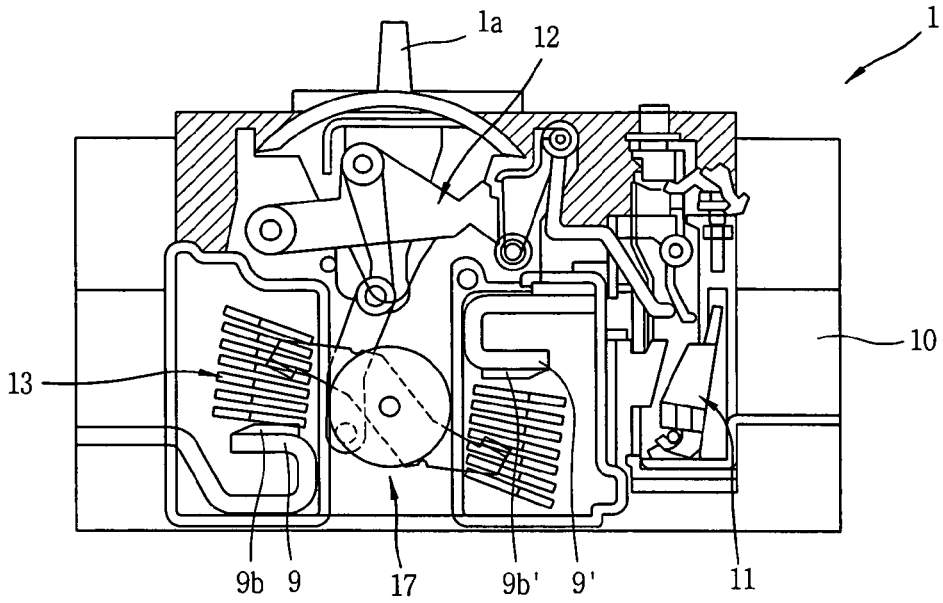
FIG. 1 CONVENTIONAL ART
FIG. 1 is a cross sectional view showing the main internal configuration of a conventional circuit breaker.
Figure 2:
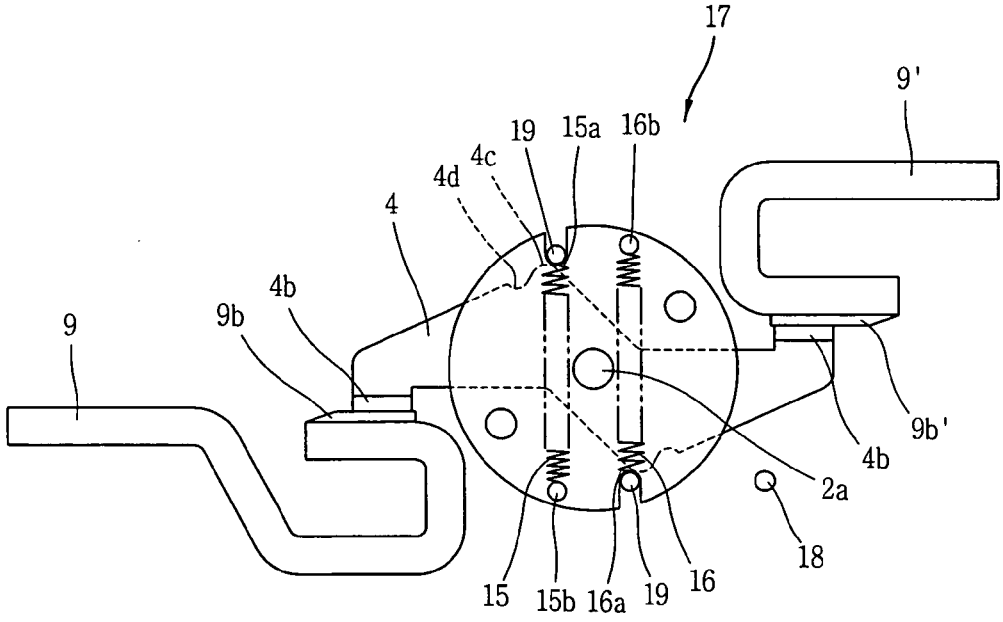
FIG. 2 CONVENTIONAL ART
FIG. 2 shows a contactor assembly for the conventional circuit breaker, which is a front view showing an On Status.
Figure 3:
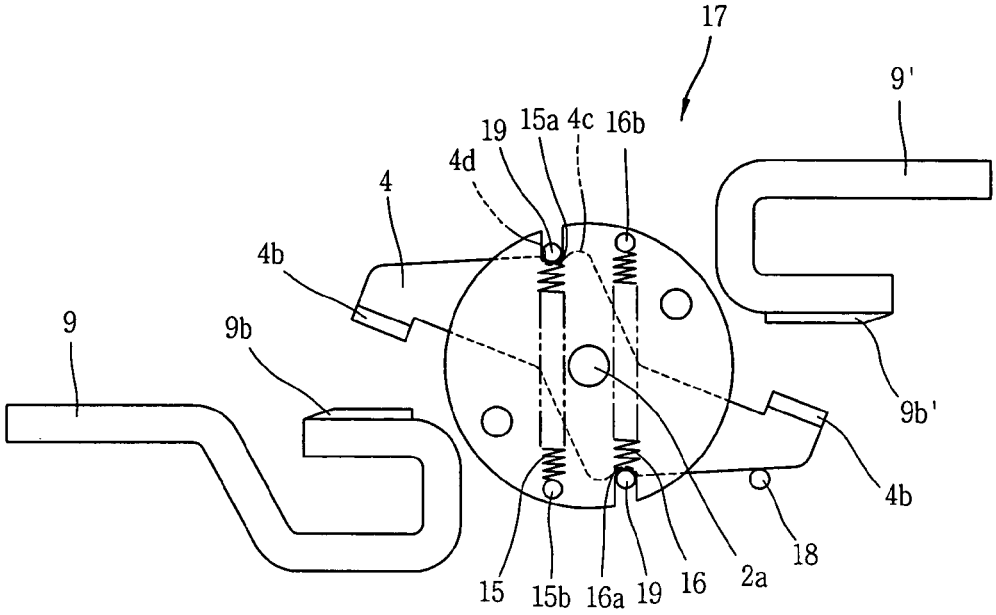
FIG. 3 CONVENTIONAL ART
FIG. 3 shows the contactor assembly for the conventional circuit breaker, which is a front view showing a current limiting status where the contacts are separated and opened by an electromagnetic repulsive force.

Afterwards, an on-off mechanism 12 (refer to FIG. 1) receives a trip signal from a trip mechanism 11 (refer to FIG. 1) to rotate the rotary shaft clockwise, thereby tripping the circuit breaker for power distribution.

As explained above, in the present invention, even when the movable contactor contacts the stationary contactor, that is, the rotary shaft over travels, both ends of the springs are supported by the stationary pins fixed to the rotary shaft and the limit pins connected by the stationary pins and the link plates, and the limit pins are located on the curve surfaces of the movable contactor having a constant curvature radius at the contact position, thereby maintaining the contact pressure provided by the springs constant on the curve surfaces.

Moreover, when the limit pins are inserted into the groove surfaces by clockwise rotation of the movable contactor, the springs are stretched as long as the difference in height between the curve surfaces and the groove surface and discharge the charged elastic energy. Subsequently, the contact pressure caused by the springs becomes zero or at least smaller than the electromagnetic repulsive force. As a result, the movable contactor is prevented from returning toward the stationary contactor and the movable contactor is separated from the stationary contactor.

What is claimed is:

1. A contactor assembly for a circuit breaker, comprising:

a stationary contactor provided with a U-shaped first stationary contactor connected to a power source on an electrical circuit and a U-shaped second stationary contactor being spaced apart a predetermined distance from the first stationary contactor in horizontal and vertical directions and being connected to an electrical load on the electrical circuit;

a movable contactor provided with contacts corresponding to the first and second stationary contactors at both ends and being movable to a contact position contacting the first and second stationary contactors and a separating position where the movable contactor is separated from the first and second stationary contactors, the movable contactor being provided with groove surfaces having a first curvature radius on respective upper and lower surface thereof so that the separating position of the movable contactor can be maintained when the movable contactor rotates separately from the stationary contactors by an electromagnetic repulsive force between the stationary contactor and the movable contactor, and curve surfaces having a second curvature radius larger than the first curvature radius in succession with the groove surfaces on respective upper and lower surfaces thereof;

a rotary shaft rotatably supporting the movable contactor, being provided with an opening portion for permitting an independent rotation of the movable contactor when an electromagnetic repulsive force is generated between the movable contactor and the stationary contactor, and being further rotatable than the movable contactor at the contact position where the movable contactor contacts the stationary contactor;

a center shaft pin penetrating the movable contactor and being supported on the center portion of the rotary shaft so as to support the movable contactor on the rotary shaft;

a pair of stationary pins fixedly mounted on the rotary shaft symmetrically with each other around the center portion of the rotary shaft;

two pairs of link plates whose one ends are rotatably supported on both ends of each of the stationary pins;

a pair of limit pins rotatably supported on the other ends of the link plates and displaceable or maintaining a stopped state on the curve surfaces and groove surfaces of the movable contactor according to the position of the movable contactor; and two pairs of springs prepared such that the respective pair corresponds to each side of the rotary shaft so as to provide a contact pressure at the contact position where the movable contactor contacts the stationary contactor, one ends being supported on the stationary pins and the other ends being supported on the limit pins, wherein the stationary pins and limit pins supporting both ends of the springs are connected by the link plates, the limit pins are located on the curve surfaces of the movable contactor having a constant curvature radius at the contact position, the contact pressure provided by the springs can be maintained constant, the springs charge elastic energy according to a height difference between the groove surfaces and the curve surfaces at the contact position, and the springs discharge the charged elastic energy when the limit pins are located on the groove surfaces by the rotation of the movable contactor caused by the electromagnetic repulsive force.

2. The contactor assembly of claim 1, wherein the groove surfaces of the movable contactor have a constant curvature radius.

3. The contactor assembly of claim 2, wherein the movable contactor is provided with a vertical long hole through which a center shaft pin passes so as to be movable in a vertical direction around the center shaft pin.

* * * * *